United States Patent [19]

Raasch

[11] Patent Number: 4,695,002

[45] Date of Patent: Sep. 22, 1987

[54] DRIVEN THREAD STORAGE DEVICE

[75] Inventor: Hans Raasch, Moenchengladbach, Fed. Rep. of Germany

[73] Assignee: W. Schlafhorst & Co., Moenchengladbach, Fed. Rep. of Germany

[21] Appl. No.: 860,676

[22] Filed: May 7, 1986

[30] Foreign Application Priority Data

May 8, 1985 [DE] Fed. Rep. of Germany ..... 3516457

[51] Int. Cl.[4] ..... B65H 51/20

[52] U.S. Cl. ..... 242/47.01; 242/47.12

[58] Field of Search ..... 242/47.01–47.13, 242/47, 82, 83; 139/452; 66/132 R

[56] References Cited

U.S. PATENT DOCUMENTS

| | | | |
|---|---|---|---|
| 3,411,548 | 11/1968 | Pfarrwaller | 242/47.12 X |
| 3,759,300 | 9/1973 | Pfarrwaller | 242/47.01 X |
| 3,915,403 | 10/1975 | King | 242/47.01 |
| 3,971,522 | 7/1976 | Pfarrwaller | 242/47.01 |
| 4,092,006 | 5/1978 | Jacobsson | 242/47.01 |
| 4,208,017 | 6/1980 | Ichikawa et al. | 242/47.01 |
| 4,553,709 | 11/1985 | Bock et al. | 242/47.01 |
| 4,558,723 | 12/1985 | Tanaka et al. | 242/47.01 X |

*Primary Examiner*—Stanley N. Gilreath

*Attorney, Agent, or Firm*—Herbert L. Lerner; Laurence A. Greenberg

[57] ABSTRACT

A driven thread storage device for compensating instantaneous differences between thread feeding and withdrawal velocities in a textile machine includes a device for axially feeding thread at a feeding location, a device for axially withdrawing thread at a withdrawal location, a stationary storage drum, a driven thread guide in the form of a rotation-symmetrical disc conducting the thread to the storage drum and producing a thread balloon at the feeding location, the disc having an edge with at least one radially open thread guide slot formed therein, and a device disposed outside the thread balloon for supporting the disc.

14 Claims, 3 Drawing Figures

DRIVEN THREAD STORAGE DEVICE

The invention relates to a driven thread storage device for compensating instantaneous differences between the thread feeding velocity and the thread withdrawal velocity in a textile machine which produces, finishes and/or processes yarns, including axial thread feeding and axial thread withdrawal devices, a stationary storage drum, and a driven thread guide conducting the thread to the storage drum.

If the thread feeding velocity is greater than the thread withdrawal velocity, the thread is wound onto the storage drum in adjacent windings If the thread withdrawal speed then becomes greater than the thread feeding speed, the thread is still coiled onto the storage drum, but it is withdrawn from the storage drum from above, so that the number of stored windings decreases.

A situation may also occur in which all of the windings have been removed from the storage drum and the thread withdrawal speed is equal to the thread feeding speed. In this case, which rarely occurs, the storage drum is temporarily not used.

It is accordingly an object of the invention to provide a driven thread storage device which overcomes the hereinafore-mentioned disadvantages of the heretofore-known devices of this general type, and which is applicable for all cases in which the thread is only stored from time to time, such as during the exchange of spools at constant thread feeding speed, or while making a thread splice with the thread being continuously fed. It is therefore essential to introduce the thread into the thread storage device quickly and without problems, and to end the storage function just as quickly and problem free.

With the foregoing and other objects in view there is provided, in accordance with the invention, a driven thread storage device or magazine for compensating instantaneous differences between thread feeding and withdrawal velocities in a textile machine for producing, finishing and/or processing yarns, comprising means for axially feeding thread at a feeding location or side, means for axially withdrawing thread at a withdrawal location or side, a stationary storage drum, a driven thread guide in the form of a rotation-symmetrical body or disc conducting the thread to the storage drum and producing a thread balloon at the feeding location, the disc having an edge with at least one radially open thread guide slot formed therein, and means disposed outside the thread balloon for supporting the disc.

Three support means distributed around the circumference of the disc are sufficient to guide and hold the disc securely In practice the disc is driven by friction If the thread contacts the edge of the disc, it is caught by the thread-guiding slot, or by one of a plurality of guide slots and the thread guide can subsequently conduct the thread to the storage drum in the conventional manner.

In accordance with another feature of the invention, the supporting means are support rollers having flanges overlapping and engaging the edge of the disc. The flanges do not require much height. They serve to guide the disc realiably, but do not obstruct the running of the thread if the thread guide slot is deeper than the flanges.

In accordance with a further feature of the invention, the edge of the disc is expanded like a flange. Since only the edge of the disc is actually important, the disc can also be formed of a hub, spokes and a rim, or it can have holes or openings between the edge portion and the hub, which can serve the function and have the appearance of spokes. A flange-like expanded edge assures an especially reliable guide for the disc, especially if the support means are constructed as support disc pairs with a common rotary shaft. In this case, each support disc requires only one edge.

It is not necessary for all of the support rollers or support disc pairs to be provided with edges. With a suitable placement of the support rollers or support disc pairs, it is sufficient if only two of three or four support rollers or support disc pairs are provided with edges.

In accordance with an added feature of the invention, the disc has a central shaft having bearings for the storage drum.

In accordance with an additional feature of the invention, the central shaft also has a bearing for a winding displacement device. Roller bearings are preferred for this application.

In accordance with again another feature of the invention, the winding displacement device is a wobble plate being supported on the shaft at an acute angle and having radially directed fingers disposed in slots formed in the storage drum. The wobble plate only moves if the storage drum rotates This is not the case during the regular storage operation. However, the wobble plate "wobbles" relative to the thread guide and therefore serves the function of pushing or sliding the deposited thread loops or spirals on the surface of the storage drum in the direction in which the thread is withdrawn.

In accordance with again a further feature of the invention, there is provided a machine frame and means for spatially fixing the position of the storage drum with mechanical forces, the position fixing means including an element fixed at the machine frame and an element disposed at the storage drum, at least one of the elements being a permanent or electro-magnet and the other element being a magnet or a body that can be magnetized.

After the thread has been captured by the thread guide, the storage drum cannot begin to wind-up the thread without special provisions. To make this possible, in accordance with again an added feature of the invention, there is provided a machine frame and a thread holding device attached to the machine frame being movable toward the storage drum for blocking traversing motion of the thread around the storage drum at the withdrawal location or side. If the thread holding device is actuated, the thread is caught by it. The device remains activated until approximately one loop or spiral is wound around the storage drum The friction is then great enough so that the winding can proceed without difficulties After the thread holding device is deactivated, the thread is withdrawn above the storage drum forming a thread balloon on the withdrawal side.

In accordance with again an additional feature of the invention, there is provided a machine frame having a given threading and unthreading position, the thread guide being movable into a zero position in which the thread guide slot is disposed at the given threading and unthreading position A defined threading and unthreading position provides the advantage of supplying controllable and movable thread guiding means outside of the thread storage device in a defined place, without inhibiting the thread storage operation.

It is of advantage if the threading and unthreading position has thread guiding contours, to capture the thread quickly and reliably.

In accordance with yet another feature of the invention, there is provided a zero position setting device moving the thread guide into the zero position This facilitates the insertion and removal of the thread, since the thread guide is in the zero position.

In accordance with yet a further feature of the invention, there is provided a drive motor driving the thread guide, the zero position setting device including a marking on the disc and a sensor controlling the drive motor and responding to the marking. It is advantageous if the sensor is a reflecting light barrier or gate, with an optical axis directed through an opening in the flange-like expanded edge of the disc onto a reflector, which is attached to the storage drum.

Since the thread slides along the edge of the disc until it falls into the thread guide slot, it is advantageous if the edge of the disc has rounded edges.

Since the invention provides the possibility of letting the thread guide rotate at its operating speed before it has captured the thread, reliable capturing of the thread must be guaranteed even under this condition. For this purpose, the direction or orientation of the thread guide slot should make an acute angle with the rotational direction of or tangent to the disc. This configuration of the thread guide slot captures the thread more reliably and the thread cannot unintentionally fall out of the slot after it has been caught.

In accordance with yet an added feature of the invention, there is provided a drive for the disc, the supporting means including a friction drive for the disc being connected to the drive. In accordance with a concomitant feature of the invention, the disc has gear teeth disposed outside the thread balloon at the thread feeding location or side, and including a drive gear engaging the teeth, the teeth having a gap on the edge of the disc through which the thread guide slot is formed. Other features which are considered as characteristic for the invention are set forth in the appended claims.

Although the invention is illustrated and described herein as embodied in a driven thread storage device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
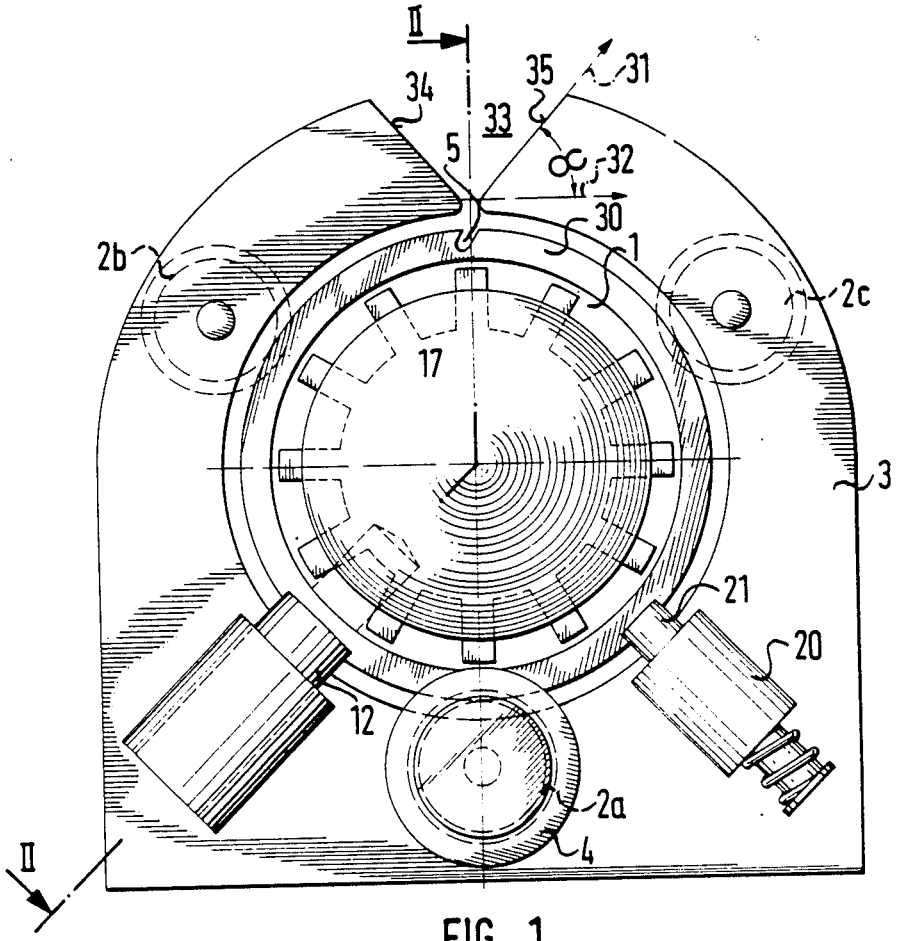
FIG. 1 is a diagrammatic, front-elevational view of a thread storage device according to the invention.
Figure 2:
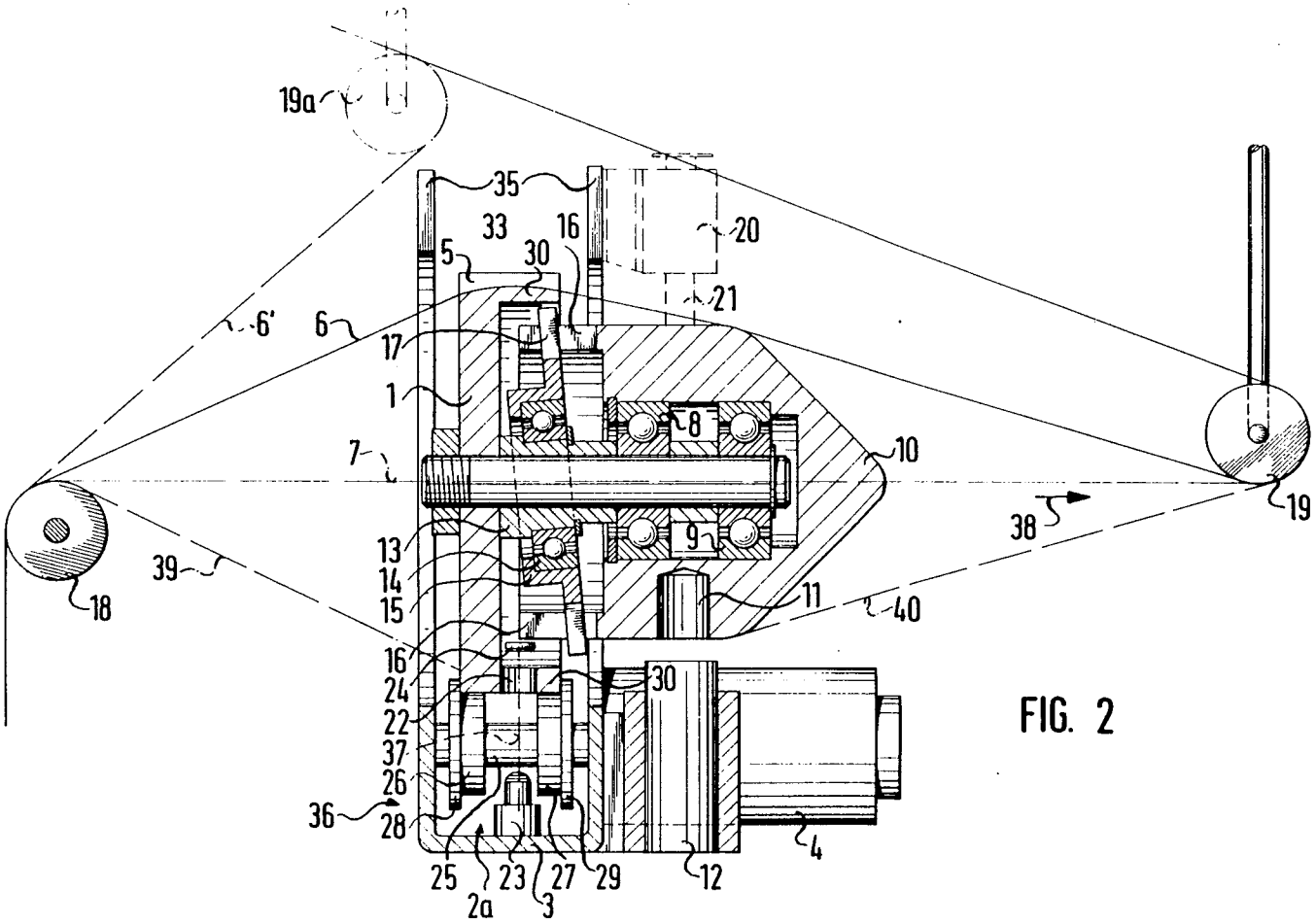
FIG. 2 is a cross-sectional view of the thread storage device, taken along the line II—II in FIG. 1, in the direction of the arrows.

Referring now to the figures of the drawings in detail and first, particularly to FIGS. 1 and 2 thereof, there is seen a thread guide or carrier 1 of a thread storage device which is constructed in the form of a disc that rests on three supports in the form of support roller configurations 2*a*, 2*b* and 2*c*. The support roller configurations are uniformly distributed about the periphery of the disc 1 and are rotatably supported in a machine frame 3.

Each support roller configuration has a common rotary shaft 25 with two support discs 26 and 27. The support disc 26 has a wheel flange 28 and the upport disc 27 has a wheel flange 29.

The rotary shaft 25 of the support roller configuration 2*a* is connected to a drive motor 4, as shown in FIG. 2. If the motor 4 is activated, the support roller configuration 2*a* drives the disc 1 by friction at a rim-type expanded edge 30 of the disc. The disc 1 is screwed to a central shaft 7. The shaft 7 is provided with bearings 8, 9 for a storage drum 10 and an additional bearing 14 for a winding-displacement or shifting device in the form of a wobble plate 15. The wobble plate 15 is supported on the shaft 7 of the disc 1 at an acute angle. The wobble plate 15 is provided about the periphery thereof with radially oriented fingers 17 which engage in slots 16 formed in the storage drum 10.

The edge 30 of the disc 1 has a radially open thread guide slot 5. According to FIG. 1, the direction or orientation 31 of the thread guide slot 5 forms an acute angle $\alpha$ with the rotational direction or tangent 32 of the disc 1.

The position in which the storage drum is fixed in space is obtained by magnetic forces acting between an element 12 in the form of a permanent magnet fixed to the machine frame 3, and an element 11 which is also a permanent magnet disposed at the storage drum 10. Opposite poles of the permanent magnets face each other. A sufficiently wide gap is provided between the two permanent magnets 11 and 12 through which a thread 6 to be stored can move freely.

According to FIG. 1, a controllable thread holding device 20 is connected to the machine frame 3. The device 20 is formed of an electro-magnetic drive having a plunger 21 which can be moved foward up to the surface of the storage drum 10, if the electromagnetic drive is actuated In FIG. 2 the thread holding device 20 is indicated in phantom because in the sectional view of FIG. 2 it is actually positioned further down and covered by other parts.

A threading and unthreading position 33 is provided at the frame 3 of the machine. Thread guiding contours 34 and 35 are located at the position 33 The thread guiding contours are expanded outwardly like a funnel and lead the thread into the thread guide slot 5, if the thread guide 1 is in a zero or initial position. This is always the case if the thread guide slot 5 stands at the threading and unthreading position 33. Otherwise, the thread is guided against the edge 30 of the disc by the guiding contours 34, 35 and the thread is automatically placed into the guide slot 5 due to the rotation of the disc 1.

A zero setting device which is designated as a whole by reference numeral 36 in FIG. 2, is provided for placing the thread guide 1 into its zero position The zero setting device 36 has a sensor 23 which controls the drive motor 4 of the support roller configuration 2*a*. The sensor 23 responds to a special marking 22 which is provided on the disc 1.

Since the sensor 23 in the illustrated embodiment is formed of a reflection light barrier or gate, the above-mentioned marking 22 is made in the form of an opening in the flange-type expanded edge 30 of the disc 1. The optical axis 37 of the reflection light gate 23 is directed onto a reflector 24 which is attached to the storage drum 10. The reflection light gate 23 is functionally or operatively connected to the drive motor 4; the connection is not shown in the drawings. After receiving a control command, the gate 23 causes the drive motor 4 to set the device to its zero position by sending control signals for forward or reverse motor rotation until the optical axis 37 is aligned with the reflector 24. Then the thread guide slot 5 is in the zero position for threading or unthreading the thread, as shown in the figures.

In the zero position, the wobble plate 15 whose bearing 14 is inclined relative to the shaft 7 by means of a support bushing 13, is behind the thread guide slot 5. As the thread guide 1 continues to rotate after receiving the thread 6 and the winding of the thread onto the storage drum 10 has begun, the fingers 17 of the wobble plate 15 push the thread spiral along in the withdrawal direction 38.

The storage operation will be further explained at this point with the aid of FIG. 2. The thread 6 which is conducted over means for axially feeding the thread in the form of a first roller 18 initially moves over means for axially withdrawing the thread in the form of a second roller 19 in a position 19*a* while the thread occupies a position 6'. While the thread guide 1 is already in operation or running so that it can prepare the thread storage, the thread holding device 20 is operated, so that the plunger 21 is moved forward to the surface of the storage drum, as shown in FIG. 2. The second roller 19 is then moved from the phantom position 19*a* to the position indicated by solid lines The thread 6 traverses the threading location 33, and as the thread guide slot 5 passes by, the thread 6 moves into the slot 5. The thread can only travel up to the plunger 21 without winding itself around the storage drum 10. The thread is blocked at the plunger and from there on begins to wind itself onto the storage drum 10. At the latest after the first spiral has been produced or after sufficient time has elapsed to form the first spiral, the thread holding device 20 is turned off.

The thread 6 is then continuously taken along by the thread guide slot 5 and forms a thread balloon 39 at the thread feeding side. The withdrawal of the thread 6 around the roller 19 in the direction 38 takes place above the storage drum 10, so that the thread 6 also forms a thread balloon 40 on the withdrawal side. If the thread 6 is to be removed from the thread storage device again after all of the stored windings are used up, it is only necessary to initially bring the disc 1 to its zero position and then to move the roller 19 back to the position 19*a*.

The start of the storage operation can also be accomplished from a stillstand, by first inserting the thread in the thread guide slot 5 while the disc 1 is in its zero position and subsequently setting the disc 1 in motion.

Figure 3:
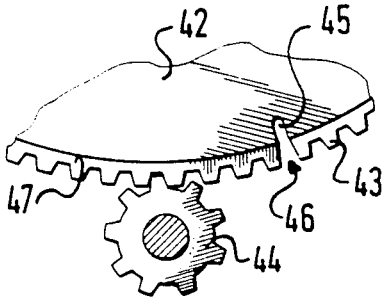
FIG. 3 is a fragmentary, front-elevational view of another embodiment of a thread guide.

An alternate version of the thread guide or disc 42 according to FIG. 3 is characterized by providing the disc with gear teeth 43 which lie outside of the thread balloon at the supply side, and by providing a drive gear 44 which engages in the teeth A thread guiding slot 45 is disposed in a gap 46 between the teeth 43. Similar to the first embodiment which was used as an example, a smooth rim 47 is provided around the disc for contact with the support configuration.

I claim:

1. Driven thread storage device for compensating instantaneous differences between thread feeding and withdrawal velocities in a textile machine, comprising means for axially feeding thread at a feeding locations, means for axially withdrawing thread at a withdrawal location, a stationary storage drum, a driven thread guide in the form of a rotation-symmetrical disc conducting the thread to said storage drum and producing a thread ballon at said feeding location, said disc having an edge with at least one radially open thread guide slot formed therein, a drive for said disc, means disposed outside said thread balloon for supporting said disc, said supporting means including a friction drive contacting said edge of said disc and being connected to said drive, a machine frame, means for spatially fixing the position of said storage drum with magnetic forces, said position fixing means including an element fixed at said machine frame and an element disposed at said storage drum, at least one of said elements being a magnet, a thread holding device attached to said machine frame, and means for moving said thread holding device toward said storage drum for blocking traversing motion of the thread around said storage drum at said withdrawal location whether or not said disc is operating.

2. Driven thread storage device according to claim 1, wherein sasid supporting means are support rollers having flanges overlapping and engaging said edge of said disc.

3. Driven thread storage device according to claim 1, wherein said edge of said disc is expanded like a flange.

4. Driven thread storage device according to claim 1, wherein said disc has a central shaft having a bearing for said storage drum.

5. Driven thread storage device according to claim 4, wherein said central shaft also has another bearing, and including a winding displacement device supported on said other bearing.

6. Driven thread storage device according to claim 5, wherein said winding displacement device is a wobble plate being supported on said shaft at an acute angle and having radially directed fingers disposed in slots formed in said storage drum.

7. Driven thread storage device according to claim 1, wherein said at least one element. is a permanent magnet.

8. Driven thread storage device according to claim 1, wherein said at least one element is an electro-magnet.

9. Driven thread storage device according to claim 1, wherein the other element is a magnet.

10. Driven thread storage device according to claim 1, wherein the other element is a body that can be magnetized.

11. Driven thread storage device according to claim 1, including a machine frame having a given threading and unthreading position, said thread guide being movable into a zero position in which said thread guide slot is disposed at said given threading and unthreading position.

12. Driven thread storage device according to claim 11, including a zero position setting device moving said thread guide into said zero position.

13. Driven thread storage device according to claim 12, including a drive motor driving said thread guide, said zero position setting device including a marking on said disc and a sensor controlling said drive motor and responding to said marking.

14. Driven thread storage device according to claim 1, wherein said disc has gear teeth disposed outside said thread balloon, and including a drive gear engaging said teeth, said teeth having a gap on said egde of said disc through which said thread guide slot is formed.

* * * * *